United States Patent [19]

Stram

[11] 4,062,313

[45] Dec. 13, 1977

[54] INSTALLATION OF VERTICALLY MOORED PLATFORMS

[75] Inventor: Edward M. Stram, San Rafael, Calif.

[73] Assignee: Standard Oil Company (Indiana), Chicago, Ill.

[21] Appl. No.: 767,587

[22] Filed: Feb. 10, 1977

Related U.S. Application Data

[63] Continuation of Ser. No. 616,697, Sept. 25, 1975, abandoned.

[51] Int. Cl.[2] ..... B63B 35/44

[52] U.S. Cl. ..... 114/265; 61/94

[58] Field of Search ..... 9/8 P; 114/264, 265; 61/86–98; 175/7

[56] References Cited

U.S. PATENT DOCUMENTS

| | | | |
|---|---|---|---|
| 3,366,088 | 1/1968 | Gibson | 9/8 P |
| 3,648,638 | 3/1972 | Blenkarn | 114/265 |
| 3,780,685 | 12/1973 | Horton | 114/265 |
| 3,859,804 | 1/1975 | Koehler et al. | 114/265 |
| 3,919,957 | 11/1975 | Ray et al. | 114/265 |
| 3,934,528 | 1/1976 | Horton et al. | 61/98 |

FOREIGN PATENT DOCUMENTS

| | | | |
|---|---|---|---|
| 133,438 | 11/1960 | U.S.S.R. | 61/87 |

*Primary Examiner*—George E. A. Halvosa

*Assistant Examiner*—Jesus D. Sotelo

*Attorney, Agent, or Firm*—John D. Gassett

[57] ABSTRACT

This invention relates to the installation of a Vertically Moored Platform over a selected well site. The platform or structure is supported on a buoyant gravity base and floated to a position over the subsea well site. The gravity base is then ballasted to effect tilting in a controlled manner. Ballasting is continued to bring the gravity base and platform back to a vertical position. The the gravity base is lowered from engagement with the floating structure with cables to the sea floor while maintaining the floating structure in a positive buoyancy state. In the preferred embodiment a large-diameter drive pipe is inserted through each receiving passage in the gravity base and into the soil or rock beneath the gravity base where it is anchored. A conductor is then inserted through the drive pipe and anchored or cemented to the soil or rock beneath the drive pipe. A riser pipe is then inserted into the drive pipe and secured to the conductor. The upper end of the riser pipe is secured to the floating structure. Up to 32 or more such risers are connected between the floating structure and the gravity base. The riser pipes are then placed under tension and the cables used to lower the gravity base are then removed. Drilling operations then proceed through each of the risers. Modification of this installation and equipment necessary therefor are described.

10 Claims, 20 Drawing Figures

INSTALLATION OF VERTICALLY MOORED PLATFORMS

This is a continuation, of application Ser. No. 616,697, filed Sept. 25, 1975, now abandoned.

RELATED APPLICATION

U.S. patent application, Ser. No. 611,286, filed Sept. 8, 1975, entitled "Installation of Vertically Moored Platforms," by Kenneth A. Blenkarn and William D. Greenfield, relates to a similar problem as does this specification.

BACKGROUND OF THE INVENTION

Field of the Invention

This invention relates to the installation of a structure floating on a body of water. More particularly, the invention relates to a floating structure from which drilling or production operations are carried out. It relates especially to the installation of Vertically Moored Platforms in deep water.

In recent years there has been considerable attention attracted to the drilling and production of wells located in water. Wells may be drilled in the ocean floor from either fixed platforms in relatively shallow water or from floating structures or vessels in deeper water. The most common means of anchoring fixed platforms includes the driving or otherwise anchoring of long piles in the ocean floor. Such piles extend above the surface of the water and support a platform attached to the top of the piles. This works fairly well in shallow water; but, as the water gets deeper, the problems of design and accompanying costs become prohibitive. In deeper water it is common practice to drill from a floating structure.

In recent years there has been some attention directed toward many different kinds of floating structures. One system receiving attention for mooring is the so-called Vertically Moored Platform. Such a platform is described in U.S. Pat. No. 3,648,638, issued Mar. 14, 1972, Kenneth A. Blenkarn, inventor. Key features of the disclosure in that patent are that the floating platform is connected to an anchor only by elongated parallel members and the floating structure has buoyancy means designed especially with respect to the trough of a design wave so as to minimize mooring forces imposed on the vertically elongated members which anchor the structure, such as those forces which may be caused by passing waves.

The closest or most pertinent prior art of which we are aware is the aforesaid U.S. Pat. No. 3,648,638. However, the installation described here is considered an improvement over the installation method and system described in that patent.

BRIEF DESCRIPTION OF THE INVENTION

Briefly, a preferred embodiment of this invention concerns a Vertically Moored Platform having limited lateral movement for use in a body of water. The floating structure including a deck is set on a gravity base and the two are floated as a unit to the selected location. Then, a special ballasting procedure is described for the floating structure to bring it to a stable draft for lowering the gravity base. This utilizes a ballast-controlled tipping of the structure to maintain positive stability in all stages and thus preventing a tipping in an unknown direction. The gravity base is lowered by cables from the floating structure to the ocean floor. The gravity base is filled with a heavy fluid or other ballasting material and the lowering cables serve as temporary anchoring members between the gravity base, which can serve as the anchor, and the floating structure.

Thereafter, riser pipes are connected between the gravity base and the floating structure. Then, drilling operations can be conducted through the riser pipes.

Spacing means are provided to keep the riser pipes of each leg in a fixed horizontal position relative to each other. In a preferred embodiment, the spacer means are mounted on the gravity base between the gravity base and the structure before the structure is floated into position. Then, as the gravity base is lowered, the riser separators are picked off the gravity base one at a time as the barge is lowered. The spacers are attached by sleeve guides to the deadline of the lowering cable reeve-up to prevent rotation and assure proper alignment of the sleeves.

A better understanding of the invention may be had from the following description taken in conjunction with the drawings, in which

DRAWINGS

DETAILED DESCRIPTION

Figure 1:
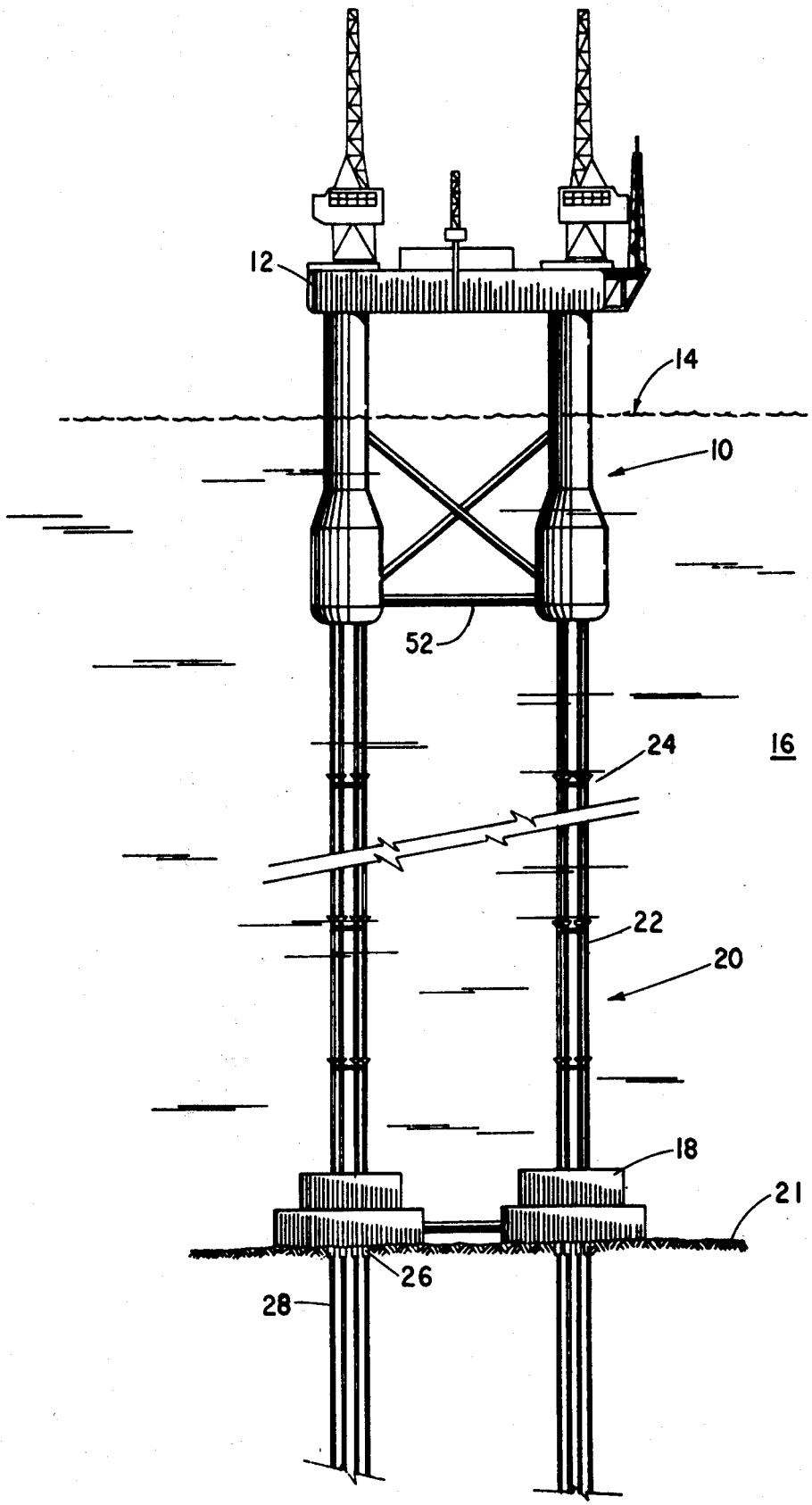
FIG. 1 illustrates a Vertically Moored Platform after installation.

Attention is next directed to the drawings, and, in particular, FIG. 1, which illustrates a Vertically Moored Platform with gravity base and risers installed and ready for drilling. There is shown a buoyance means 10 supporting a deck 12 above the surface 14 of the body of water 16. The buoyancy means 10 is connected to gravity base 18 by four legs 20. Each leg 20 includes a plurality, in this case, eight, of riser pipes 122. Spacers 24 are provided vertically along each leg 20 to keep the riser pipes 22 apart and to modify their resonant frequency to prevent flutter. Each gravity base section 18 has a plurality of punch tubes 26 which are forced by the weight of the gravity base into the sea floor 21. Drive pipes 28 extend downwardly from punch tubes 26. After the Vertically Moored Platform is installed, as shown in FIG. 1, drilling operations are conducted through individual risers 22 from the top of platform 12. The rest of the figures in the drawings are useful in explaining how the installation of the Vertically Moored Platform of FIG. 1 is effected.

Figure 5:
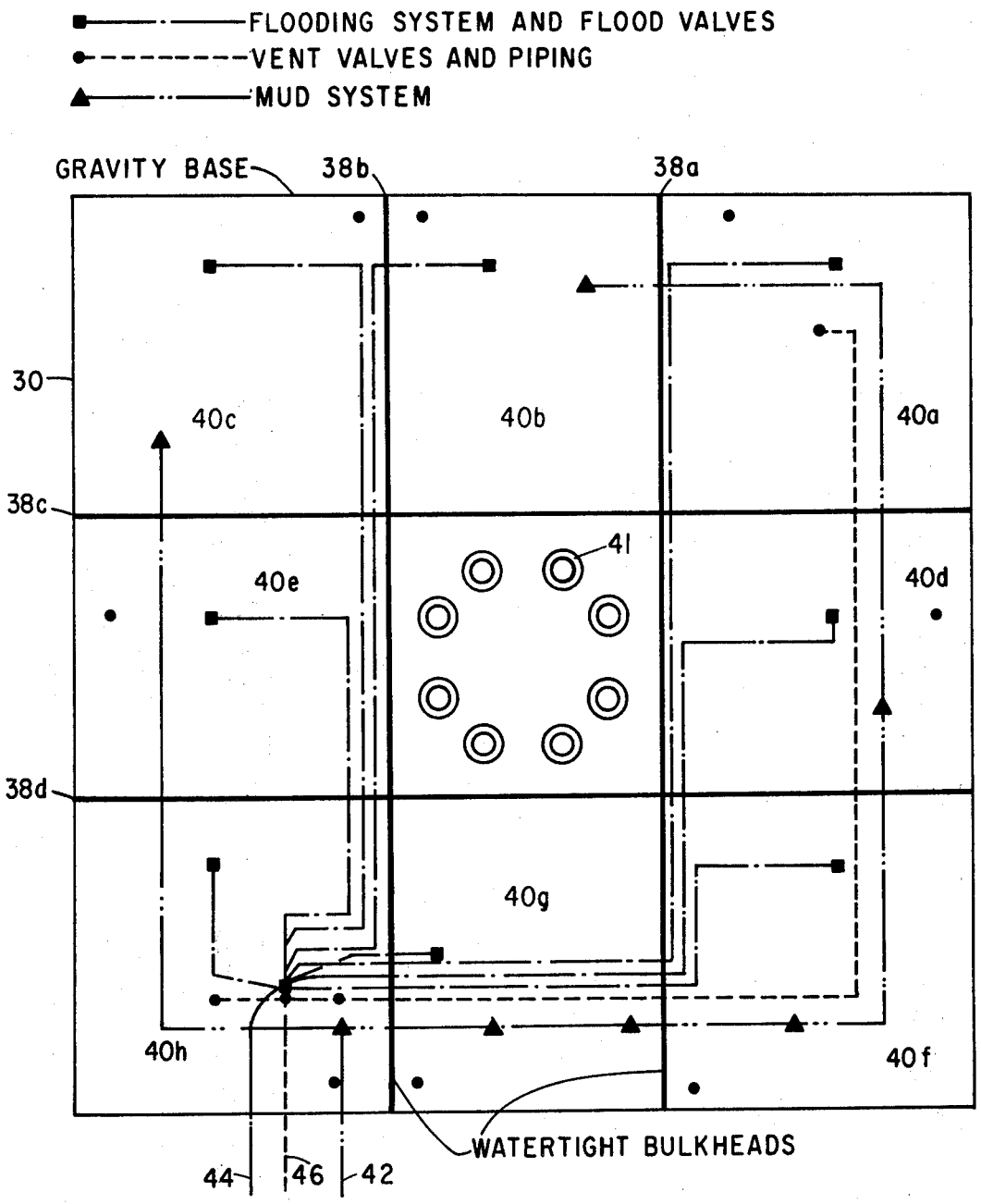
FIG. 5 is another plan view of one section of the gravity base of FIG. 3 showing inner compartments and flooding system.

The Vertically Moored Platform of FIG. 1 must be transported to its desired location. The preferred way of transporting it is to low it in a floating condition. This can be done in a manner illustrated in FIG. 2. The platform 12 and buoyancy means 10 are supported above the surface 14 of the body of water 16 by gravity base 18. As can be seen in FIG. 3, gravity base 18 has four sections 30, 32, 34, and 36, connected by suitable cross bracings. Each gravity base section 30, 32, 34, and 36 can be considered a compartmentalized tank. As shown in FIG. 5, means are provided to add water or heavy drilling mud or even unset cement to the various compartments, so as to give it the proper mass. As shown in FIG. 5, the base 30, for example, is shown having watertight bulkheads 38*a*, 38*b*, 38*c*, and 38*d*. These watertight bulkheads form compartments 40*a* through 40*h*. There is a mud system 42, a waterflooding system 44, and a vent valve and piping system 46. Controls on flowlines extend to jacket deck 12, so that any one or all of the various compartments can be varied, flooded, or have a drilling mud added thereto. A drilling mud is usually water which has solids added thereto to make it heavier. The center compartment has vertical passages 41 extending therethrough. As will be seen, it is through these passages 41 that casing, etc., are inserted into the ground. It is also through these that the lower ends of the riser pipes are connected.

Figure 2:
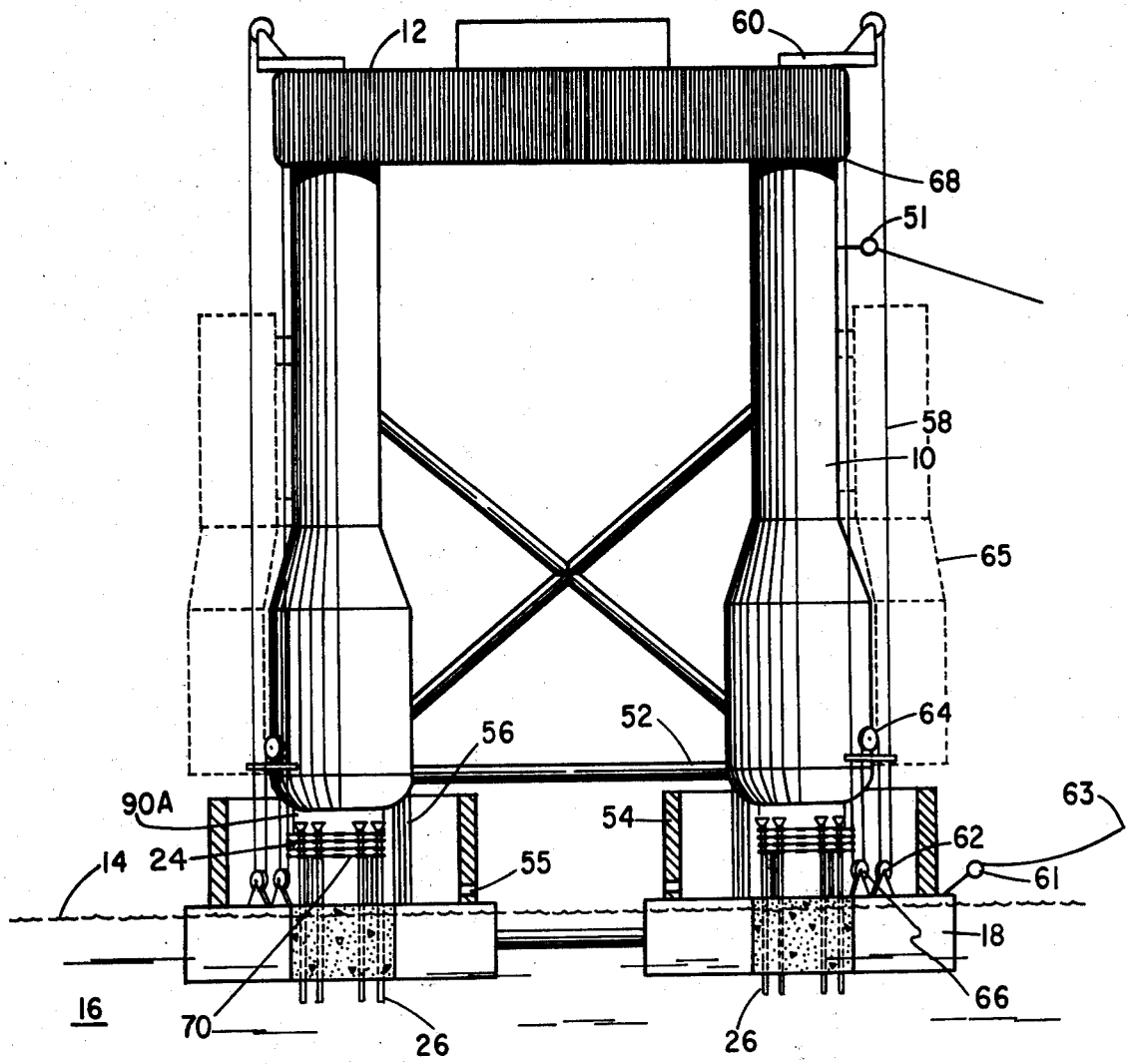
FIG. 2 illustrates the towing position of the Vertically Moored Platform supported on gravity bases with auxiliary buoyancy tanks attached to jacket.
Figure 3:
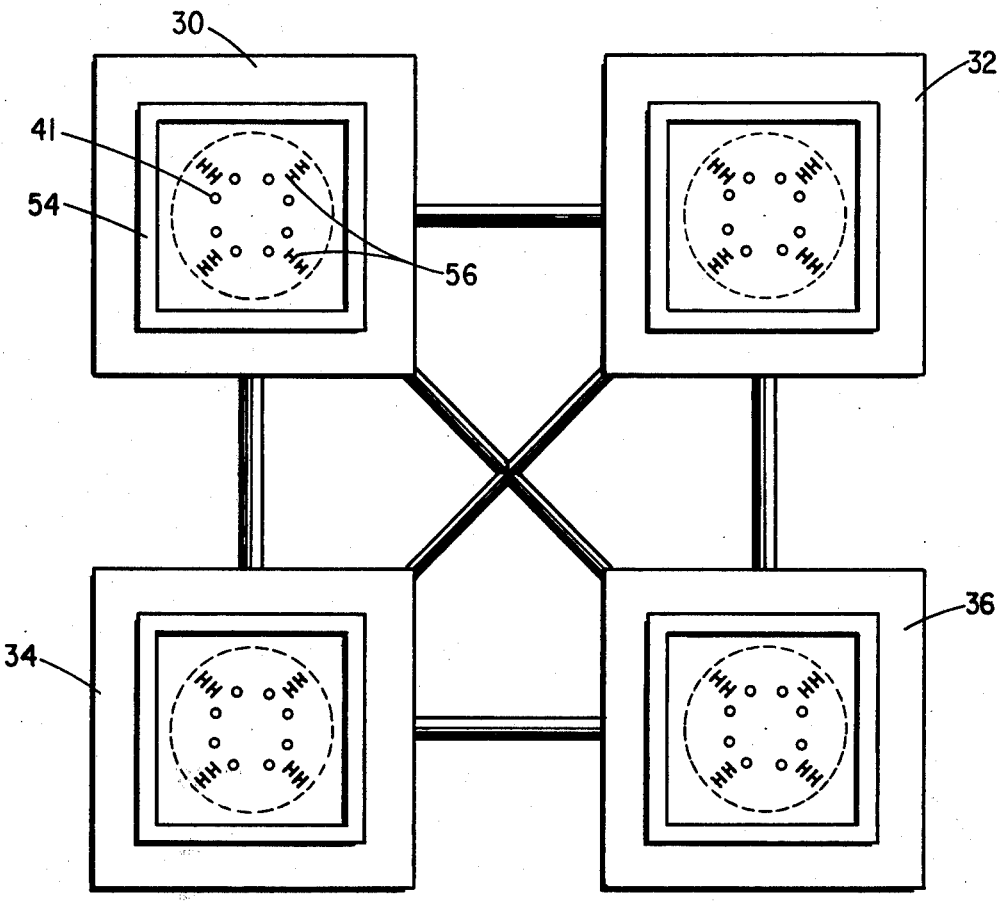
FIG. 3 illustrates a plan view of a gravity base showing sections of the gravity base corresponding to the four legs of the Vertically Moored Platform of FIG. 7.
Figure 4:
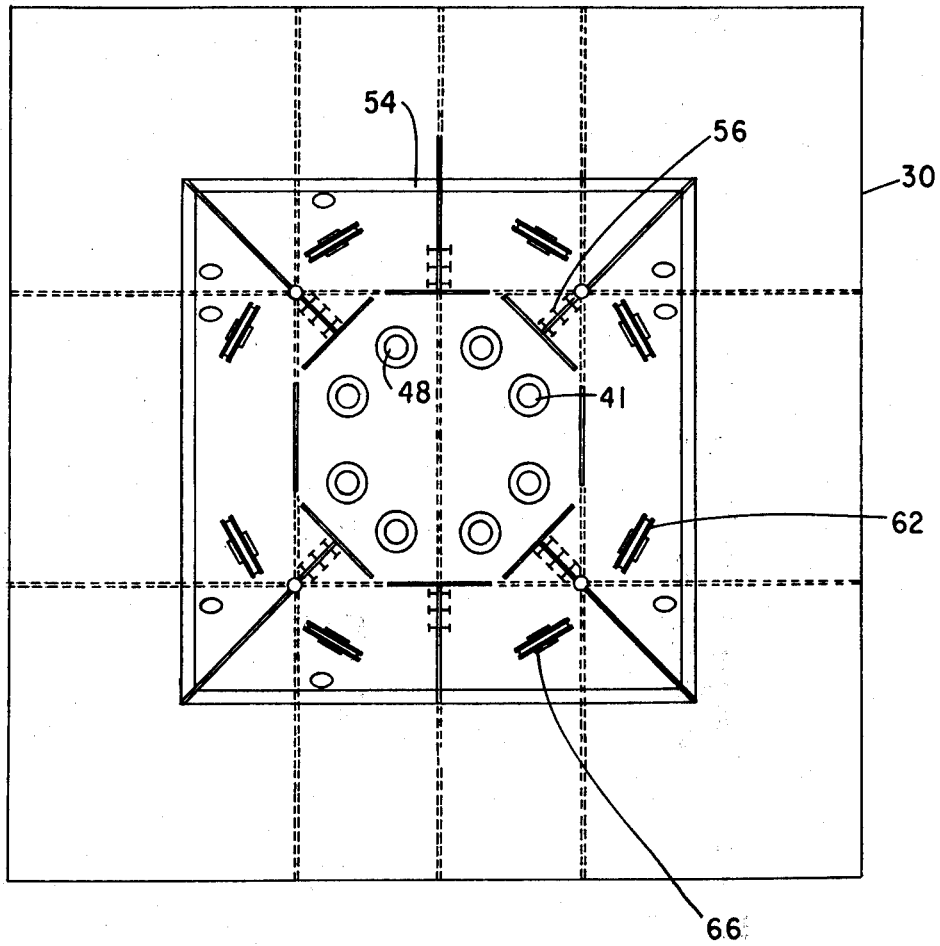
FIG. 4 shows a plan view of one section of the gravity base showing more details than FIG. 3.

Attention is now directed back to FIG. 2, in which the buoyant members 10 are supported by supports or cradles 56. There may be three, four, or more cradles per leg. A line 58 extends from winch 60 on top of deck 12 to sheave 62 on gravity base 18 back to a sheave 64 on buoyancy means 10, back under a sheave 66, which is adjacent sheave 62, and back to the surface where it is tied at point 68 to platform 12. There is preferably a plurality of such line and sheaves, normally four. The arrangement of sheaves 62 and 66 on each section of the gravity base is shown in FIG. 4. Centralizers 24 are stacked within enclosure 54. These centralizers will be discussed in more detail later. The enclosures 54 are provided with holes 55 so that during lowering of the gravity bases 18 water can flood the interior of enclosure 54.

The size of the structure illustrated in the drawings will vary from location to location and will depend upon many factors, such s the sea conditions expected, the number of wells expected to be drilled from the platform 12, the depth of the drilling, etc. However, typically, one might expect that deck 12 would be square-shaped, having dimensions of about 200 by 200 feet (61 to 61 meters). The height of deck 12 from the base of buoyancy means 10 is about 240 feet (73 meters). Typically, each leg of buoyancy means 10 has a displacement of about 7350 tons. The size of each gravity base in FIG. 3 for each leg is typically about 100 feet (30 meters) square and 24 feet (7 meters) high.

The device of FIG. 2 is towed by suitable towing tugs connected to padeye pilot 61 in gravity base 18. Upon arrival at the well site, the tow lines 63 are released and the structure is allowed to float free. What I wish to do is to lower the gravity bases 18 to the bottom 21. This can be accomplished in various ways. However, it is believed that the following system generally gives the best stability to the operation. In this procedure, the tiedowns from the gravity base to the jacket and riser spacers are released. This can be done in any convenient manner, the details of which are not shown. Inasmuch as the gravity base 18 and the buoyancy means 10 are soon to be separated, the buoyancy means 10 must be lowered into the water where they can effectively support platform 12. It is not believed desirable to try to lower the four legs of the buoyancy means 10 in a level manner. The reason for this is that in any kind of wave action of the sea it would be most difficult to do and the buoyancy means 10 would become quite unstable and would tilt to one side of the other. Auxiliary buoyancy tanks 65 may be added on each leg, as shown in FIG. 2, to provide additional stability. Inasmuch as it is considered highly likely that the platform would tilt in one direction or another under any condition, the location of the auxiliary buoyancy tanks and the sequence of ballasting is chosen to tilt the platform means in a controlled manner. After I release the tiedowns between the gravity base and the buoyancy means 10 of the Vertically Moored Platform, I tension the lowering cables 58 to an appropriate value, for example, typically, 100 kips exerted by each winch. Typically, there would be four winches per leg of the platform. The tension is maintained on these winches during the initial lowering.

I start ballasting gravity base sections 32 and 36, as illustrated in FIG. 3. I first start flooding compartments 40*a*, 40*d*, and 40*f*, as illustrated in FIG. 5. Partitions 38*a* to 38*d* create compartments 40*a* to 40*h* in each gravity base section. Attention is next directed to FIG. 6, which shows a preferred sequence of steps A through M of flooding to obtain a controlled mooring under gravity bases. This flooding is continued until I reach a tilt of about 17°, as indicated in step C. I next start flooding all of the compartments, as illustrated in steps D and E. When I get to step E, the structure has reached a tilt of nearly 20°, which is about the maximum I desire to obtain. Continued flooding of all of the compartments gradually brings the tilt back to zero. The sequence of these steps is illustrated in steps F, G, and H. When I get to step H, there is no tilt at all, i.e., a level condition. Before this lowering of the gravity base and platform, the two lines from the tugs are disconnected from padeyes 61 and may be connected (with slack) to the padeyes 51 (FIG. 2), which are located high on the legs, which would be about five feet or so above the stillwater line when the device is completely lowered. These remain in place during the lowering of the gravity base. Water is continually added to the various compartments to bring the device through steps I, J, and K. K represents the position when the desired stillwater level is reached on the legs of buoyancy means 10. At this time, mud which is a heavy drilling fluid, may be added to the gravity base through displacement of the ballast water. This is accomplished by manipulating the control lines 42, 44, and 46, illustrated in FIG. 5. No details of the exact operations will be given, as it is apparent how to do it once the problem is set forth and suitable apparatus is disclosed. I then continue lowering the base 18 until it reaches the bottom of the ground at the bottom of the bed of water, as shown in step M. Ballast is then added to buoyancy means 10, as required, and the proper tension applied on the cables, using winches so that the final jacket draft is whatever is selected, which typically might be about 150 feet.

Figure 6:
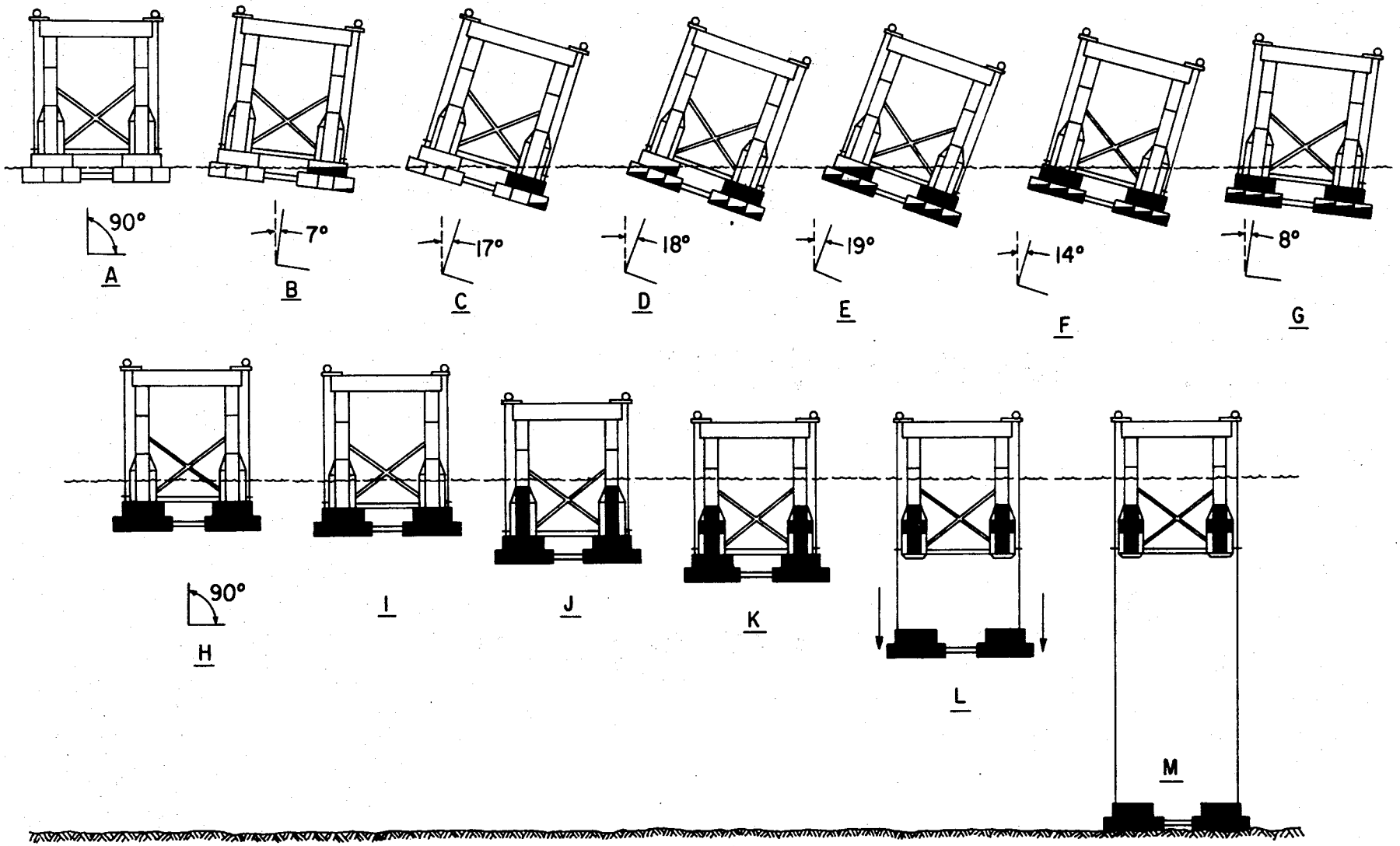
FIG. 6 shows a sequence of positions of the Vertically Moored Platform during installation of the gravity base.
Figure 7:
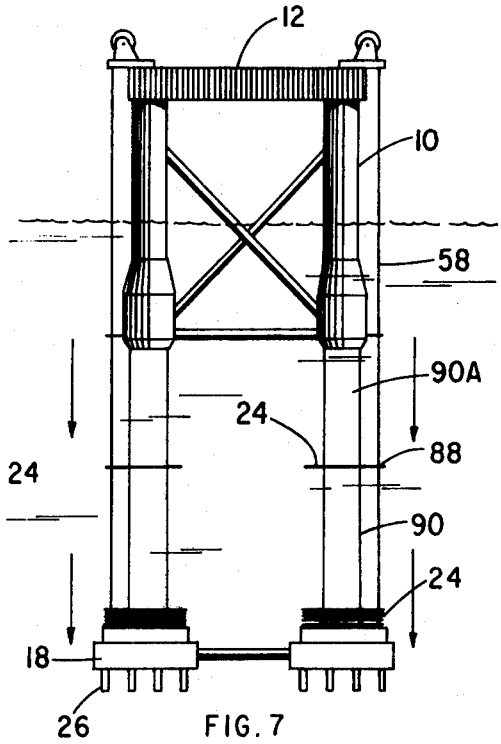
FIG. 7 shows the gravity base partially lowered and with one riser spacer or centralizer in position.
Figure 8:
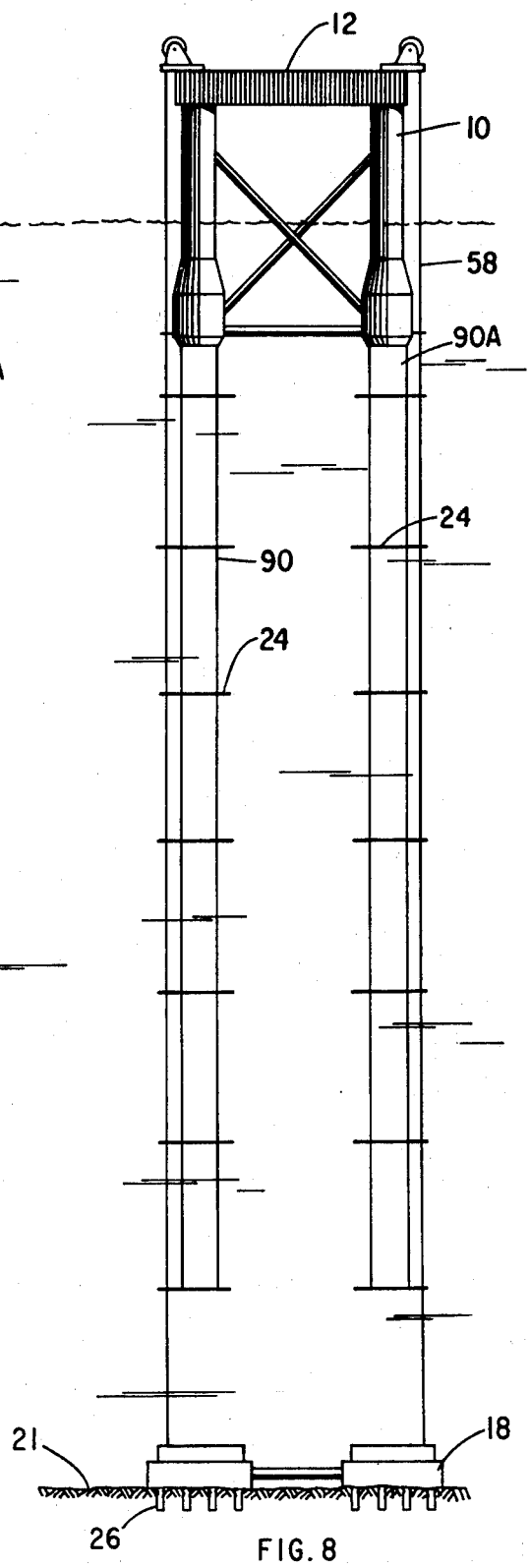
FIG. 8 illustrates the Vertically Moored Platform with thegravity base on bottom and connected to each other by cable.
Figure 12:
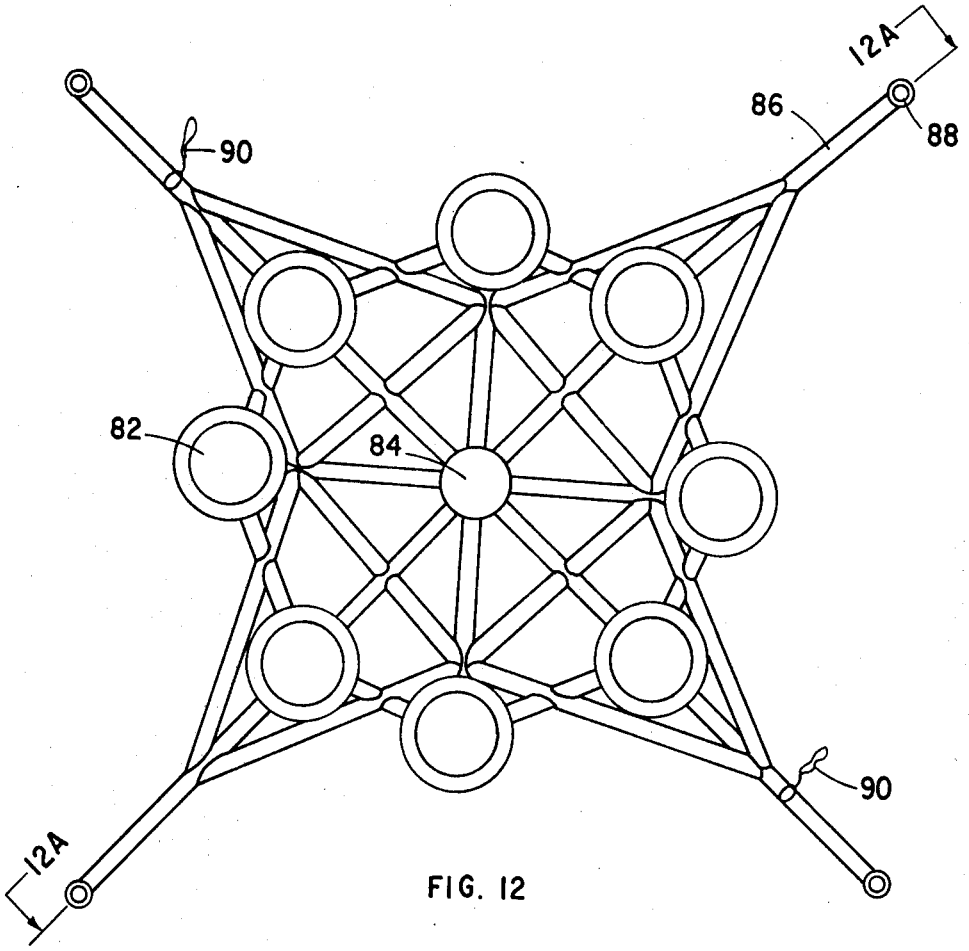
FIG. 12 illustrates a plan view of a centralizer or spacers for one leg of the Vertically Moored Platform and FIG. 12A illustrates a section along 12A—12A of FIG. 12.
Figure 12A:
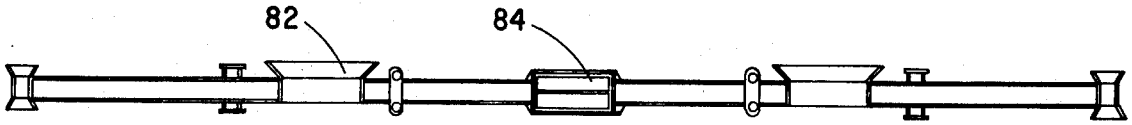

In connection with FIG. 6, I discussed the lowering of the gravity base. No mention was made of the lowering of the riser spacers which occurs simultaneously. A brief discussion will now be made of the centralizers and how they are lowered. Attention is next directed to FIGS. 7, 8, and 12. As shown in FIG. 2, the riser spacers 24 are stacked within the enclosure wall 54 of the gravity base 18. FIG. 12 shows a plan view of a spacer assembly. The particular spacer assembly is not a part of my invention, but illustrates a suitable assembly. There is one group of such spacers for each of the four legs of the platform. Each spacer includes a plurality of vertical passages 82, which are spaced in more or less a circle about the center of the spacer 84. There are four arms 86 which extend outwardly from center 84. These arms terminate in a ring 88. As shown in FIG. 7, tension cables 58 pass freely through rings 88. As can be seen in FIG. 2, the spacers of FIG. 12 are stacked one on top of the other. They are connected by spacing lines 90, which permit the spacers to hang in a vertically spaced relationship as the gravity base 18 is lowered to the floor 21. These hang spaced apart more or less like a Venetian blind. As can be seen in FIG. 8, then, we have a platform 12 supported by buoyancy means 10, which is anchored by lines 58 to the gravity base 18 which rests on the bottom 21. Riser spacers 24 are positioned all along lines 58 at the desired locations and that point is determined by the length of the line segments 90. Spacers 24 are shown equally spaced vertically but can be at any desired spacing, which may be different for the different depths of water. The riser pipes are not installed yet at the stage of progress shown in FIG. 8. The operation for vertical positioning of the spacers can be modified. For example, all spacers can be lowered with the gravity base until it reaches bottom. This can be accomplished by making line segment 90A long enough to reach from buoyancy means 10 to the bottom and then pull up on line segment 90A until the spacers are in the position shown in FIG. 8.

Figure 9:
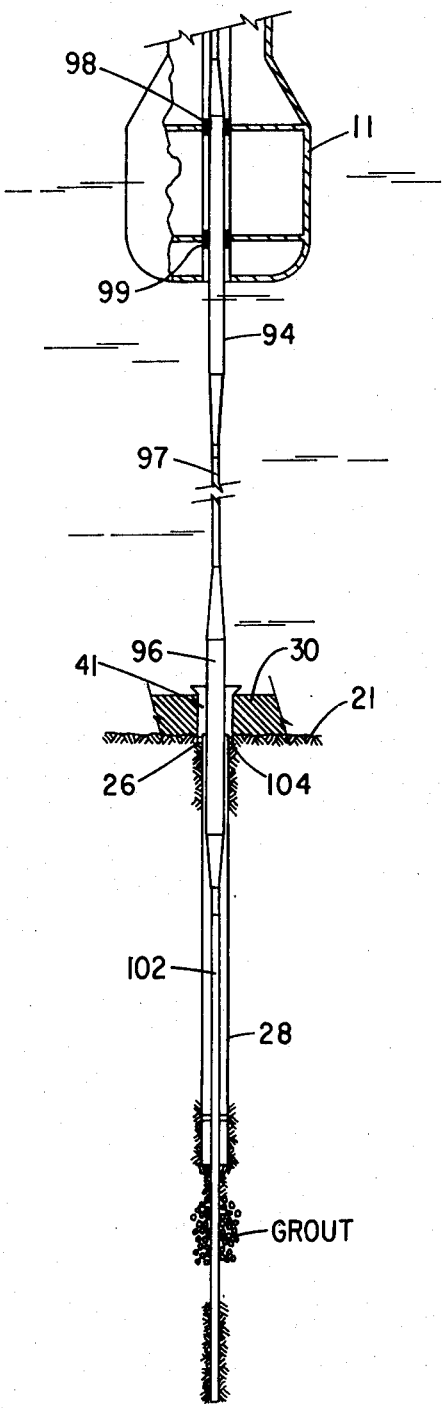
FIG. 9 shows one riser including upper and lower terminations extending from one of the buoyant means of the platform to the ocean floor.
Figure 10:
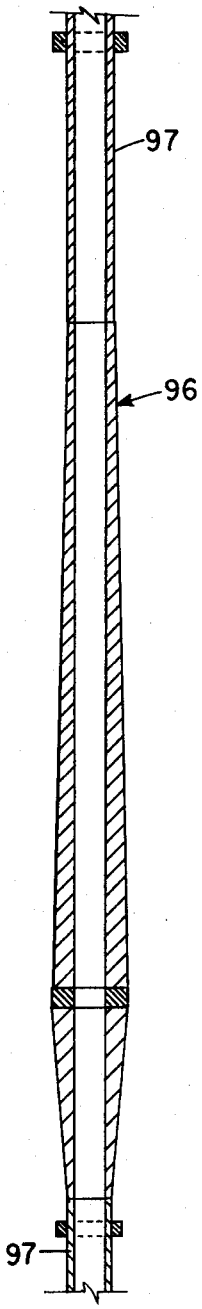
FIG. 10 illustrates a lower terminator of the riser.
Figure 11:
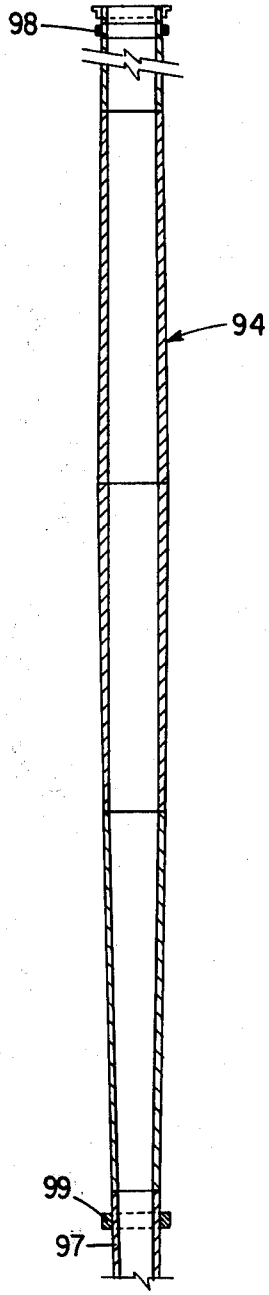
FIG. 11 illustrates an upper terminator of the riser.

I shall next discuss one method of installation of the riser pipes and removal of tension cables 58, so that an assembly such as shown in FIG. 1 can be effected. The particular system for doing this is not a part of the present invention, but is a suitable means of carrying out the step of my installation method for the Vertically Moored Platform. Attention is next directed to FIG. 9, which shows one typical riser pipe extending from one leg of buoyancy means 10 through gravity base section 30, resting on the bottom 21. This includes an upper terminator section 94 and a lower terminator section 96, which extends through vertical opening 41 of gravity base section 30. Opening 41 is funnel-shaped at the top to aid in guiding the riser pipes. It is known that if a tubular member is held under tension subject to rotational movement or angular movement, stresses concentrate in the ends. One way of meeting this problem is to make the end sections sufficiently strong to withstand any stresses which may concentrate therein. That is what is done here. FIG. 10 illustrates a lower riser terminator 96, and FIG. 11 illustrates an upper riser terminator 94. In FIG. 10, the standard part of the riser 97 is shown as the regular riser which is normally about 20 inches in diameter. The terminators have this thickness of the wall increased to withstand the stresses which may be encountered. The stresses which may be encountered will be determined by a number of factors, such as the depth of the water, the length of the riser pipe 97, the currents, the waves, etc. These concentrations of stresses can be determined by standard engineering principles. The thickness of the terminators is selected for the particular material so that the concentration of stresses so determined is acceptable.

The upper terminator 94 bears upon jacket 11 by two horizontal bearings 98 and 99. Means of applying vertical tension to the riser pipe will be discussed in relation to FIGS. 17 and 18. The lower riser terminator 96 extends down through punch tubes 26 and drive pipe 28. The lower end of riser pipe lower terminator 96 is connected to a conductor casing 102 which is about the same diameter as riser pipe 97. The lower terminator has a reasonably close fit inside the drive pipe.

Figure 15:
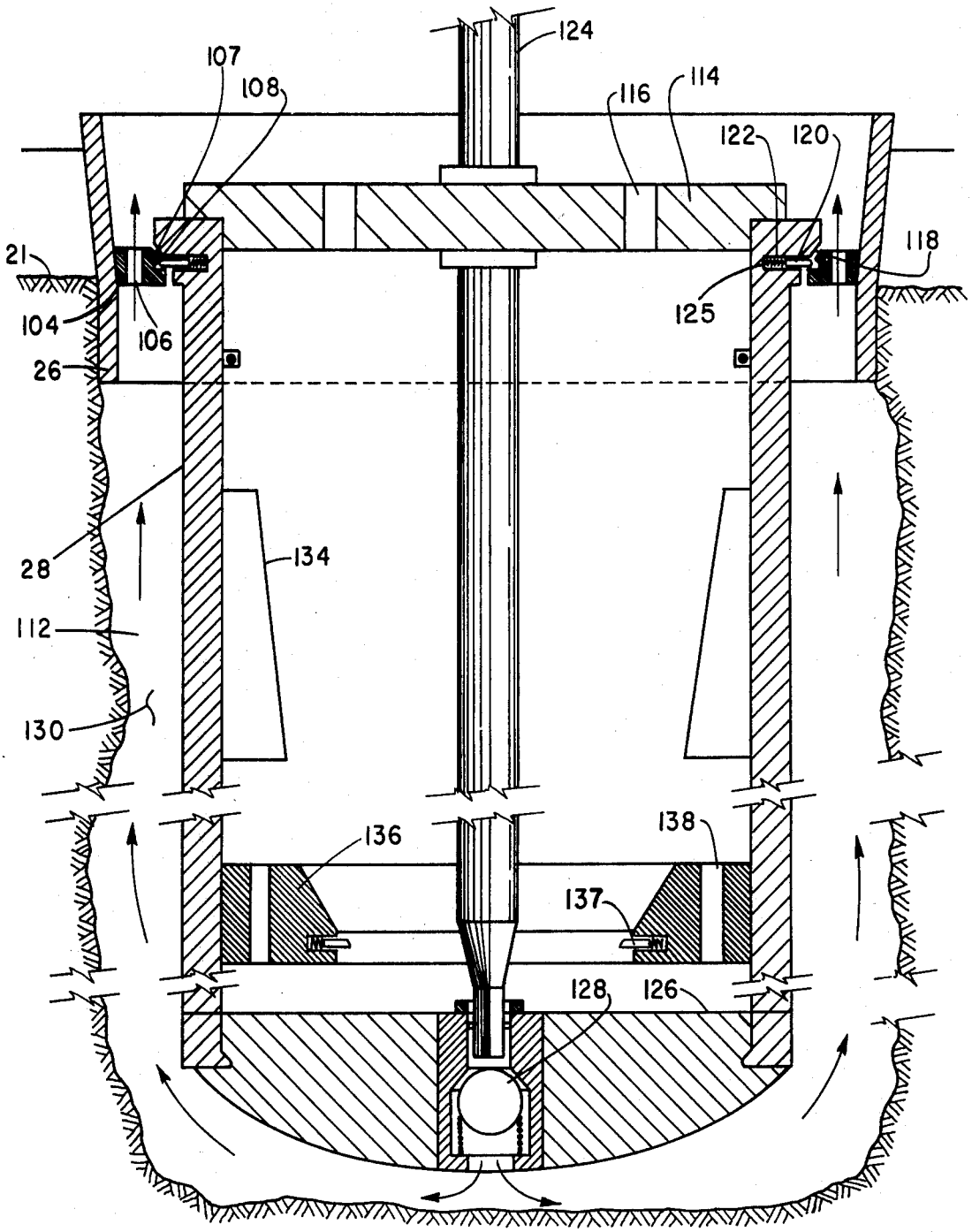
FIG. 15 illustrates one means of lowering the drive pipe into the hole and into locking engagement with the gravity base.

Attention will next be given to means of setting the drive pipe. In this regard, attention is directed to FIG. 15, which shows the lower end of punch tube 26 which extends below the bottom 21. A ring 104 is fastened to the punch tube 26 and is provided with a plurality of vertical holes 106. The inner face of the ring 104 is sloping downwardly and has a locking groove 108. A hole 112 is either washed out or drilled out below punch tube 26 for the drive pipe 28. The hole 112 for the drive pipe 28 can be made in any known manner. Shown in FIG. 15 is a lowering tool 114 which has vertical ports 116. The lowering tool 114 is connected to the drive pipe 26. The upper end of drive pipe 26 is provided with a downwardly facing shoulder 118 which complements shoulder 107 of ring 104 of the punch tube. A locking ring or pin 120 is provided in a groove 122 within the upper shoulder of the drive pipe and ejection spring 125 is provided to force the ring 120 outwardly. As the drive pipe is lowered downwardly through ring 104, ring 120 is compressed inwardly. Once the locking groove or ring 108 has reached the pin, ring 120 snaps out into locking engagement. The lowering tool 114 is lowered on a string of drill pipe 124. The lower end of the string of drill pipe has a closure 126, having check valve 128. It is desired to cement the drive pipe 28 in place, so a cementing slurry is pumped down through drill string 124 past check valve 128 and up into the annulus 130 with returns through port 106. Drive pipe 28 may contain centering ribs 134 for the lower terminator of the riser pipe and it also includes a mudline suspension element 136 having vertical ports 138 for subsequent cement circulation. Conductor casing 102 is secured to drive pipe 28 by any suitable means such as by latching pins 137.

Once the drive pipe is in position, I remove the lowering tool 114. We then go in with a drill bit on the lower end of drill pipe 124 and drill out drillable closure 126. I then continue drilling until I have drilled a sufficient depth of hole to take care of the required length of conductor casing which will be about the same size as riser pipe 97 which will normally be about 20 inches.

Figure 16:
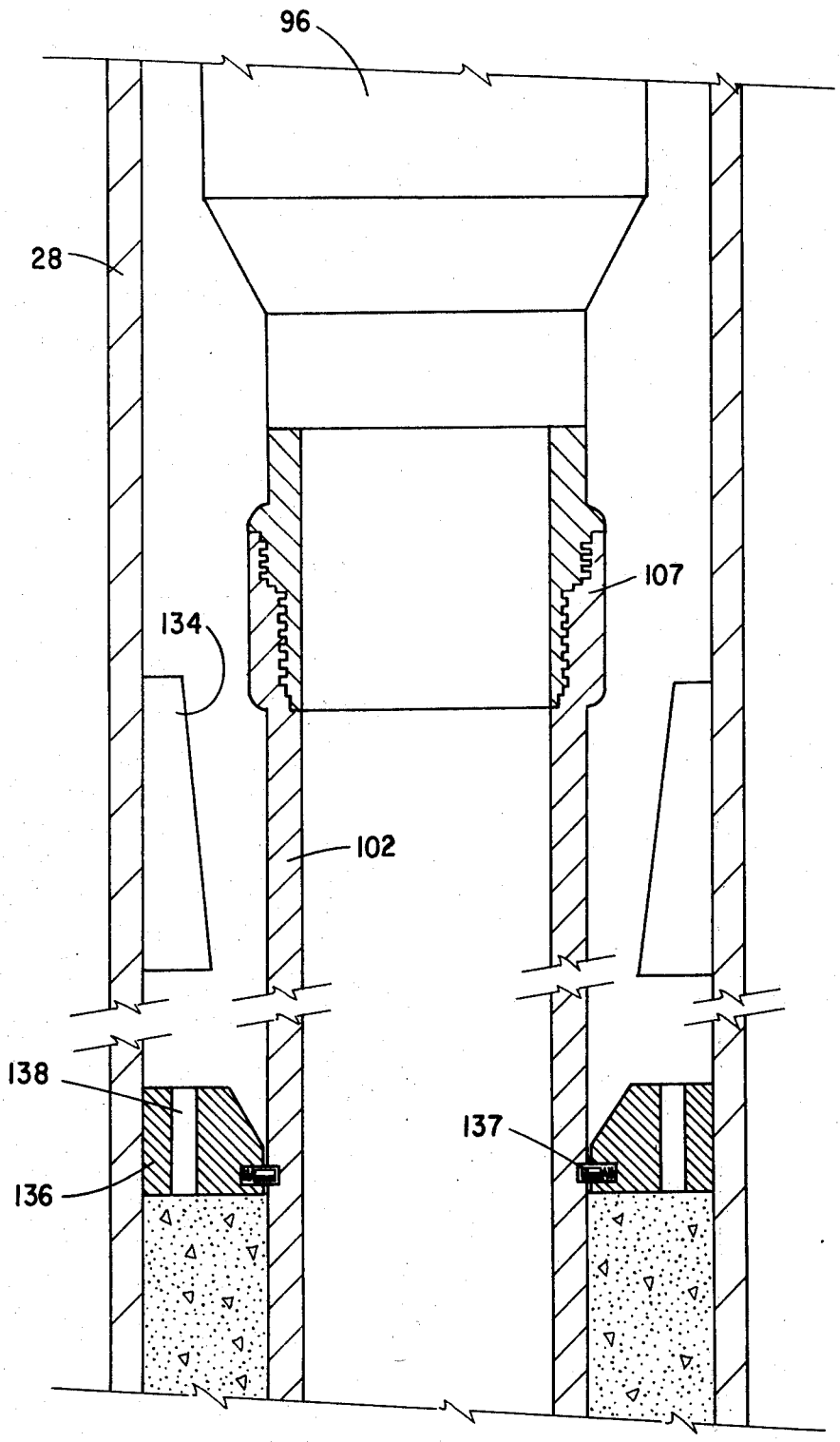
FIG. 16 illustrates a connection of the lower terminator of the riser with a conductor pipe in the drive pipe beneath the gravity base.

The 20-inch casing then is run and seated on mudline suspension 136. I provide locking means such as ring 137 on this, too, to prevent upward movement, as seen more clearly in FIG. 16. The 20-inch casing is then cemented in place. If the 20-inch casing is set deep enough, it can be the primary anchoring means.

Figure 13:
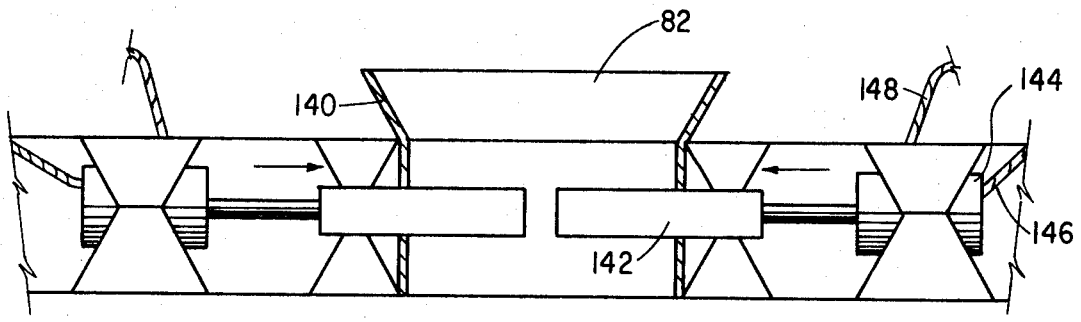
FIG. 13 illustrates one passage in the spacer of FIG. 12 and means for securing the spacer to the riser.

At this point, I am ready to run riser pipe 97. As is apparent from FIGS. 9, 10, and 11, the riser terminators, the end portions, that is, are larger than the main part of the riser pipe. We have to make the holes in the spacers 24 large enough to accommodate the larger diameters of the drive pipes rather than just the diameter of the main part of the riser pipe itself. FIG. 13 illustrates one vertical opening 82 in the spacers of FIG. 12. The upper end of passage 82 has enlargement of funnel 140 which aids in stabbing the risers through the openings 82. Mounted adjacent the vertical passage 82 is a pair of rams 142 driven by hydraulic motors 144. Hydraulic motors 144 can be doubleacting so that rams 142 can be driven either in or out in relation to the hole 82. Hydraulic power through one hydraulic line 146 drives it in and through line 148 drives it out. The inner surface of rams 142 is curved to give a reasonable fit, but not necessarily a tight one, with the portion of the riser pipe in port 82.

Figure 14:
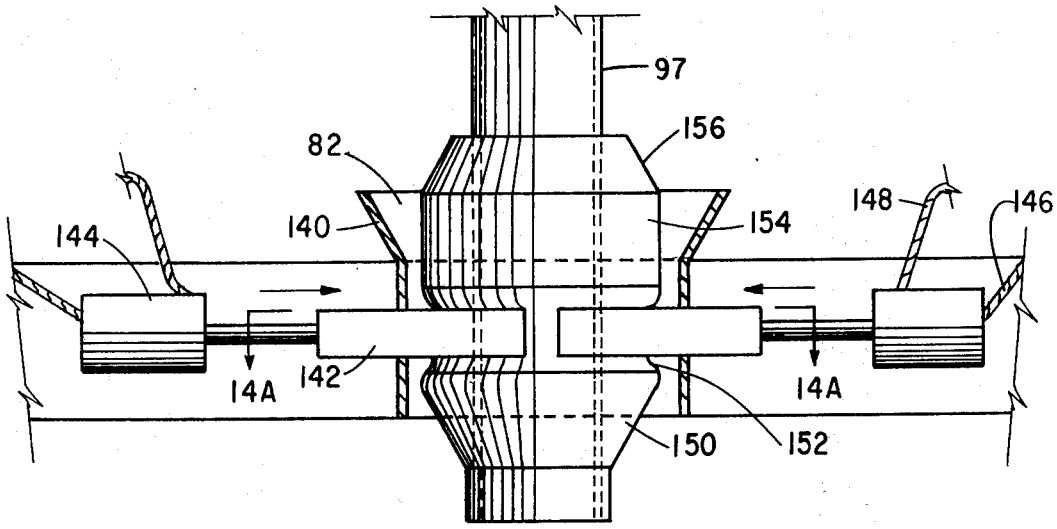
FIG. 14 illustrates the riser pipe held in position within one opening of the spacer of FIG. 12
Figure 14A:
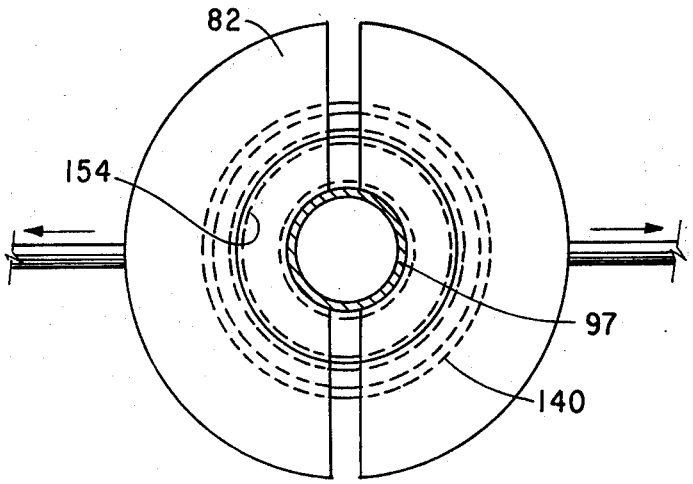
FIG. 14A illustrates a section along line 14A—14A of FIG. 14.

Attention is next directed to FIG. 14. This is similar to FIG. 13, except it illustrates a portion of the riser pipe extending through passageway 82 and held in position by rams 142. The portion of the riser pipe here is enlarged by a body 154 having a lower upwardly facing or sloping shoulder 150 with a groove 152 just above that. It is in this groove 152 that rams 142 are driven by hydraulic motor 144. The body of 154 is made preferably of some epoxy resin to minimize wear on the riser pipe 97 itself. The upper part of the body 154 has an upwardly facing shoulder 156 to help guide the riser pipe through the passage 82 in the spacer just above the spacer under consideration in the event it is desired to remove the risers. Attention is now directed to FIG. 14A which shows a cross section along the line 14A—14A of FIG. 14. This shows that rams 142 do not have to contact each other and can have a loose fit within groove 152 so that the riser pipe can rotate with respect to the rams without imparting moments. The riser pipe is lowered down through all of the centralizers and comes to position adjacent the upper end of the conductor casing 102. It is desired that the riser pipe be securely and suitably connected to the conductor. It is also desired, but not absolutely essential, that the riser pipe be connected in such a manner that it can be readily disconnected from the conductor casing. This can be accomplished by using a Non-Cross threadable casing connection. This is illustrated as 107 in FIG. 16. A Non-Cross threadable surface casing connection is illustrated in Bulletin No. 1058, the Hydril Company, 714 West Olympia Boulevard, Los Angeles, California.

Figure 17:
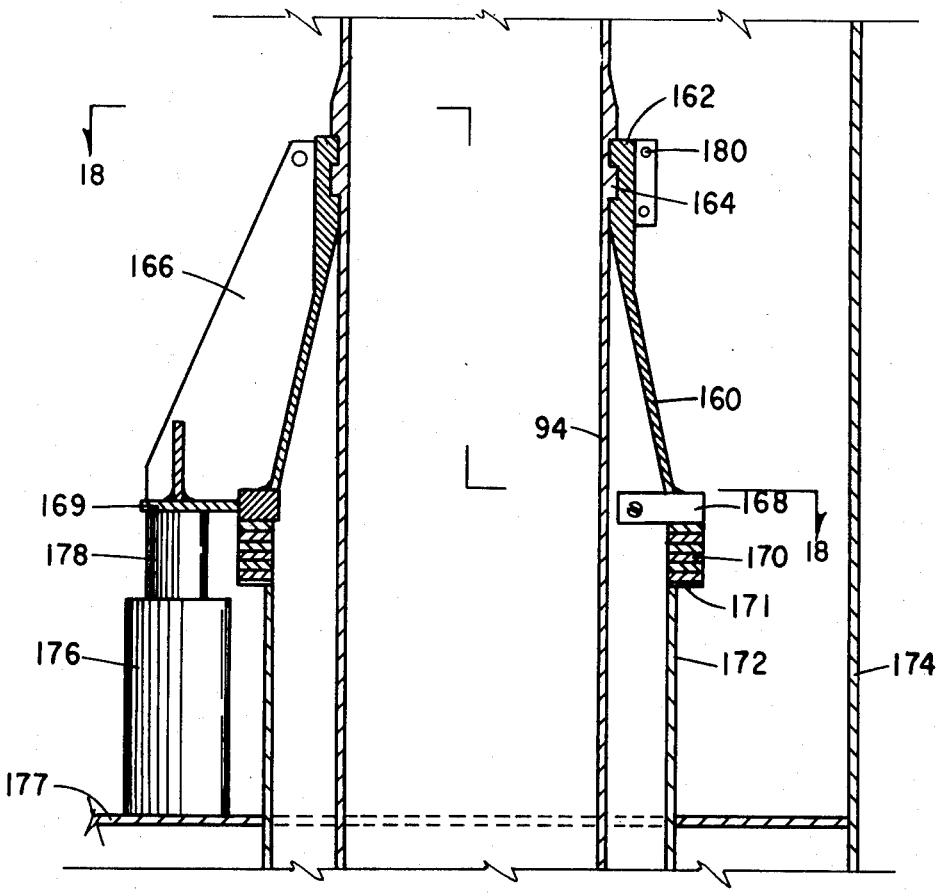
FIG. 17 is taken along the line 17—17 of FIG. 18 and illustrates a method of applying tension to the riser pipe and located within the buoyancy means.
Figure 18:
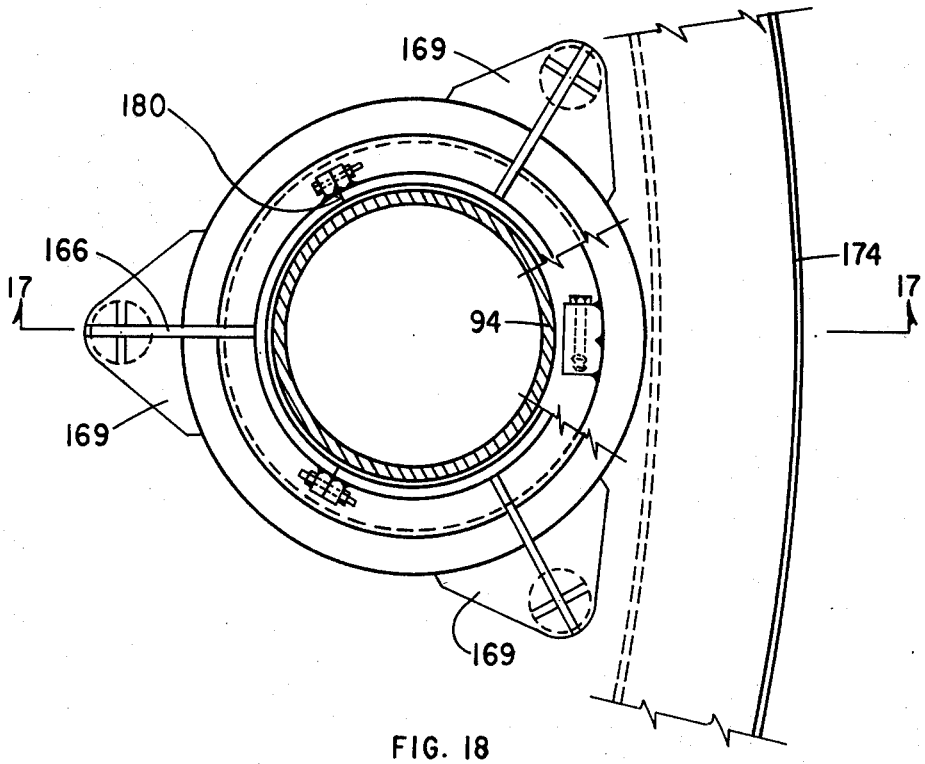
FIG. 18 is a view taken along the line 18-18 of FIG. 17.

Attention is now directed to FIGS. 17 and 18 which show means for applying tension to the riser pipes. By this system, I can adjust the tension as desired. Shown thereon, is the riser pipe upper terminator 94 extending upwardly through jacket 174. An outer shoulder 164 is provided about the upper portion of the riser pipe 94, shown in FIG. 17. A complementing bracket 162 is mounted about ring 164. Bracket 162, as can be seen in FIG. 18, is made in three pieces and connected together by bolts or other connecting means 180. Element 162 extends downwardly in a tapered position to a ring member 168. 168 has three extensions, 169, as shown in FIG. 18. A jack 176, supported from bulkhead 177, which is supported from the jacket 174, is provided with a ram 178, which contacts shoulder 169. By applying force to jack 176, the risers can be pushed upwardly with respect to jacket 174. A bearing plate 171 is attached to upright member 172 which is attached to jacket 174. Shim plates 170 are provided between items 171 and 168. What occurs is that the jack 176 pushes the riser pipe upwardly, and then a sufficient number of bearings 170 is inserted, then the jack is backed off and the force is transmitted through the bearings 170. Thereafter, proper tension is applied to riser pipes 94 and cables 58 are removed. At this time, then, all of the anchoring of the buoyancy means is through the riser pipes. It is well to point out that there are a plurality of riser pipes, typically eight, in each leg of which there are four. In this configuration there would normally be 32 riser pipes, all installed as discussed herein. Drilling and subsequent production operations can be conducted through each riser.

While the above description has been given in rather high detail, various modifications can be made without departing from the spirit or scope of the invention.

I claim:

1. A method of installing a Vertically Moored Platform at a selected site in water, said platform having four buoyant legs positioned in a rectangular pattern which comprises:

a. setting each buoyant leg on a section of a gravity base, the total buoyancy of the gravity base being sufficient to support said platform in water;

b. towing the platform and gravity base to the selected well site;

c. reducing the buoyancy of two adjacent gravity base sections until the platform is tilted toward said two gravity base sections while maintaining said gravity base in a buoyant condition completely above the bottom of said water;

d. thereafter and while said gravity base is still completely above bottom reducing the buoyancy of all sections until the center line of the platform is vertical; then simultaneously reducing the buoyancy of each said gravity base section in a manner to maintain the center line of the platform vertical until all buoyancy of each gravity base section has been removed and has a submerged weight;

e. then partially flooding the buoyant legs until an operating draft has been reached; and f. thereafter lowering the gravity base to the bottom of the body of water and securing anchor elongated members between each lowered gravity base section and its respective buoyant leg.

2. A method as defined in claim 1, in which the gravity base is lowered on cables, including the further steps of:

securing a group of a plurality of risers between each said gravity base section and its buoyant leg;

placing said risers under tensioning; and removing said cables.

3. A method as defined in claim 2, including the steps of:

providing a plurality of riser spacers for the risers along the vertical length of each group at selected intervals.

4. A method as defined in claim 1 in which said buoyant legs are bottle-shaped, having a narrow neck portion, and step (e) includes flooding the buoyant legs until the water line is on the narrow neck portion.

5. A method as defined in claim 1, including providing auxiliary tanks for each buoyant leg and step (e) includes partially flooding the auxiliary tanks.

6. A method as defined in claim 1 in which step (c) includes reducing the buoyancy of two adjacent gravity base sections until the normal vertical center line of the platform makes an angle of about 20 degress with the true vertical.

7. A method of installing a Vertically Moored Platform at a selected site, said platform having four buoyant legs positioned in a rectangular pattern which comprises:

a. setting each buoyant leg on a section of a gravity base, the total buoyancy of the gravity base being sufficient to support said platform in water;
b. positioning riser spacers on top of said gravity base;
c. towing the platform and gravity base to the selected well site;
d. reducing the buoyancy of two adjacent gravity base sections until the platform is tilted toward said two gravity base sections;
e. thereafter reducing the buoyancy of all sections until the center line of the platform is vertical; then simultaneously reducing the buoyancy of each gravity base section until all buoyancy of each gravity base section has been removed and has a submerged weight;
f. then partially flooding the buoyant legs until an operating draft has been reached; and
g. thereafter lowering the gravity base to the bottom of th body of water while simultaneously lowering said riser spacers into position and securing anchor elongated members between each lowered gravity base section and its respective buoyant leg.

8. A method as defined in claim 7 in which:

said spacers are lowered by cables at spaced intervals prior to lowering said risers.

9. A method as defined in claim 7 in which said spacers are positioned on top of the gravity base and lowered with the gravity base, then raising the spacers one by one to a level selected for each spacer after the risers are lowered.

10. A method of installing a Vertically Moored Platform at a selected site in water, said platform having at least three buoyant legs positioned in a geometrical pattern which comprises:

a. setting each buoyant leg on one of a plurality of buoyant sections of a gravity base, the total buoyancy of the gravity base being sufficient to support said platform in water;
b. towing the platform and gravity base to the selected well site;
c. reducing the buoyancy of at least one gravity base section until the platform is tilted toward said at least one gravity base section while maintaining said gravity base in a buoyant condition completely above the bottom of said water;
d. thereafter and while said gravity base is still completely above bottom reducing the buoyancy of all sections until the center line of the platform is vertical; then simultaneously reducing the buoyancy of each said gravity base section in a manner to maintain the center line of the platform vertical until all buoyancy of each gravity base section has been removed and has a submerged weight;
e. then partially flooding the buoyant legs until an operating draft has been reached; and
f. thereafter lowering the gravity base of the bottom of the body of water and securing anchor elonated members between each lowered gravity base section and its respective buoyant leg.

* * * * *

UNITED STATES PATENT OFFICE
CERTIFICATE OF CORRECTION

PATENT NO. : 4,062,313

DATED : December 13, 1977

INVENTOR(S) : Edward M. Stram

It is certified that error appears in the above-identified patent and that said Letters Patent are hereby corrected as shown below:

In the Abstract, line 8, "The the" should read --Then the--.

In the specification:

Column 3, line 11, "buoyance" should read --buoyancy--;
line 15, "riser pipes 122" should be --riser pipes 22--;
line 30, "low" should be --tow--;
line 47, "varied" should read --vented--.

Column 4, line 5, "such s" should be --such as--;
line 67, "two" should be --tow--.

In the claims:

Claim 7, Column 9, line 39, "of th" should be --of the--.

Claim 10, Column 10, line 36, "of" should be --to--.

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*